US005241949A

United States Patent [19]

Collier

[11] Patent Number: 5,241,949

[45] Date of Patent: Sep. 7, 1993

[54] RECUPERATIVE RADIANT TUBE HEATING SYSTEM ESPECIALLY ADAPTED FOR USE WITH BUTANE

[75] Inventor: David W. Collier, Rockford, Ill.

[73] Assignee: Eclipse, Inc., Rockford, Ill.

[21] Appl. No.: 18,568

[22] Filed: Feb. 17, 1993

[51] Int. Cl.[5] ..... F24C 3/00

[52] U.S. Cl. ..... 126/91 A; 431/215; 431/353

[58] Field of Search ..... 126/91 A, 92 AC; 431/350, 352, 353, 284, 285, 215; 432/209, 223, 180

[56] References Cited

U.S. PATENT DOCUMENTS 3,285,240 11/1966 Schmidt ..... 431/353

4,062,343 12/1977 Spielman ..... 126/91 A 4,401,099 8/1983 Collier ..... 126/91 A 4,673,350 6/1987 Collier ..... 126/91 A 4,705,022 11/1987 Collier ..... 126/91 A

*Primary Examiner*—James C. Yeung

*Attorney, Agent, or Firm*—Leydig, Voit & Mayer

[57] ABSTRACT

A burner head for a recuperative radiant tube burner system is constructed so as to effect clean burning of a gaseous fuel such as butane having a relatively high heat value. The burner head includes a sleeve having a frustoconical section formed with combustion air ports which cause combustion air to spin and mix thoroughly with butane discharged from a gas nozzle having a discharge orifice located downstream of certain ones of the combustion air ports.

8 Claims, 2 Drawing Sheets

RECUPERATIVE RADIANT TUBE HEATING SYSTEM ESPECIALLY ADAPTED FOR USE WITH BUTANE

BACKGROUND OF THE INVENTION

This invention relates generally to a burner assembly and, more particularly, to a burner assembly for use in a recuperative radiant tube heating system of the single-ended type. A single-ended recuperative (SER) radiant tube heating system is disclosed in Collier U.S. Pat. No. 4,705,022.

In general, such a system comprises an outer heat-resistant radiant tube having a closed forward end. Located within the outer radiant tube is an elongated recuperator tube which coacts with the radiant tube to define an annular exhaust passage for the flow of hot exhaust gases produced by a burner assembly. The latter includes a burner head which is supplied with gaseous fuel by way of a gas supply pipe.

In operation, gaseous fuel and combustion air are supplied to the burner head and are mixed therein to produce an intense flame which shoots along the forward end portion of the recuperator tube to heat the latter and the radiant tube. Exhaust gases discharged from the forward end of the recuperator tube strike the closed end of the radiant tube and flow reversely in the annular passage between the two tubes in order to further heat the radiant tube and also to preheat the combustion air flowing toward the burner head.

The burner assembly disclosed in the Collier patent is primarily designed for use with natural gas (e.g., methane) which has a low heat value when compared to a gas such as butane. When butane is used as fuel in the burner of the Collier patent, its high heat value causes the gas to burn before the gas can mix thoroughly with the combustion air. This results in unclean burning of the fuel.

SUMMARY OF THE INVENTION

The general aim of the present invention is to provide a recuperative radiant tube heating system of the above general type and having a new and improved burner head which is particularly adapted for use with butane or the like and which promotes cleaner burning by effecting earlier mixing of the fuel and combustion air so that more thorough mixing is achieved before full combustion occurs.

A more detailed object of the invention is to achieve the foregoing through the provision of a burner head in which a gas discharge orifice projects into a frustoconical sleeve formed with combustion air ports which spin the combustion air and which are strategically located relative to the gas discharge orifice so as to delay full combustion until thorough mixing of the gas and combustion air has been effected.

The invention also resides in the novel shape and location of the combustion air ports so as to enable the ports themselves to spin the combustion air and promote aggressive mixing of the combustion air with the fuel.

These and other objects and advantages of the invention will become more apparent from the following detailed description when taken in conjunction with the accompanying drawings.

DETAILED DESCRIPTION OF THE PREFERRED EMBODIMENT

Figure 1:
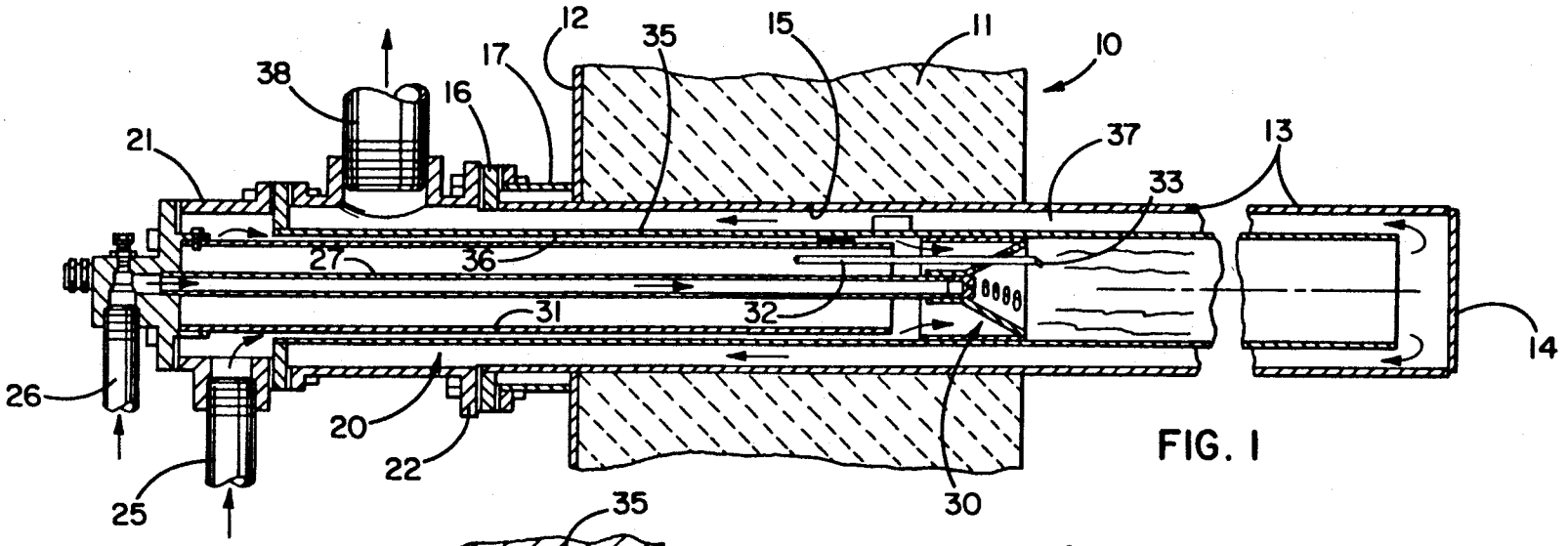
FIG. 1 is a fragmentary cross-section taken longitudinally through a new and improved radiant tube heating system incorporating the unique features of the present invention and shows the system installed in a typical furnace.

For purposes of illustration, the invention has been shown in the drawings in conjunction with a radiant tube heating system of the type which is conventionally used to heat the chamber of a furnace such as a heat treating furnace. One wall 10 of a furnace is shown in FIG. 1 and is typically made of refractory material 11 whose outer side is covered by a metal skin 12.

The heating system includes an elongated radiant tube 13 disposed within the furnace chamber and made of ceramic or other suitable heat-resistant material. The forward or downstream end of the radiant tube is closed as indicated at 14.

The radiant tube 13 extends through a hole 15 in the furnace wall 10 and includes a mounting flange 16 which is secured rigidly to a mounting sleeve 17 on the outer side of the wall. A burner assembly 20 is secured to and is partially disposed in the radiant tube and is operable to produce a high temperature flame for heating the furnace. Herein, the burner assembly includes an outer housing 21 having a mounting flange 22 which is releasably secured to the mounting flange 16 of the radiant tube 13. A combustion air pipe 25 extends into one side of the housing and communicates with a blower (not shown) or other means for producing a flow of forced combustion air. Also connected into the housing is a gas supply line 26 which communicates with an elongated gas pipe 27. The latter extends down the center of the radiant tube 13 and supports a burner head 30 on its forward or downstream end. The burner head is adapted to receive gas and combustion air and to mix the two together.

Telescoped over and spaced radially from the gas pipe 27 is an inner tube 31 (FIG. I) whose rear end is secured rigidly to the housing 21 and whose forward end terminates a substantial distance short of the burner head 30. An elongated spark rod 32 extends through the tube 31 and the burner head and includes an electrode 33 which is positioned just downstream of the burner head in order to ignite the fuel/air mixture discharged therefrom.

The overall burner assembly 20 is completed by an elongated recuperator tube 35 whose rear or upstream end is connected to the burner housing 21 in such a manner as to enable the tube 35 to communicate with the combustion air line 25. As shown in FIG. 1, the recuperator tube 35 is spaced radially outwardly from the inner tube 31 and coacts therewith to define an annular passage 36 accommodating the flow of combustion air to the burner head 30 and establishing a flow of relatively high velocity. The recuperator tube 35 extends well past the burner head and its forward end is spaced just upstream from the closed end 14 of the radiant tube 13. An annular passage 37 is defined between the radiant tube 13 and the recuperator tube 35 and permits exhaust gases to flow reversely along the recuperator tube to a discharge pipe 38 which communicates with an exhaust flue.

With the foregoing arrangement, gas flows to the burner head 30 through the gas supply pipe 27 while combustion air is supplied to the burner head via the annular passage 36 between the tubes 31 and 35. The gas and combustion air are mixed within the burner head and, as the mixture is discharged from the head, it is ignited by the spark electrode 33 so as to produce a flame. The flame shoots down the forward end of the recuperator tube 35 and serves to heat both that tube and the outer radiant tube 13. Products of combustion or exhaust gases discharged from the tube 35 are deflected by the closed end 14 of the radiant tube 13 and flow within the exhaust passage 37 and reversely along the tubes 13 and 35 to the exhaust line 38. During such flow, the exhaust gases effect further heating of the radiant tube 13 and, in addition, serve to preheat the combustion air flowing to the burner head 30 within the passage 36 and in a direction reverse to that of the exhaust gases. As is well known, preheating of the combustion air significantly increases the efficiency of the burner assembly 20.

As described thus far, the radiant tube heating system is substantially the same as disclosed in Collier U.S. Pat. No. 4,705,022. That system functions well as long as the gas which is being burned is natural gas or methane which has a relatively low heat value. Other gases such as propane have a higher heat value while still other gases such as butane have a still higher heat value. When butane or propane are used as fuel in the system disclosed in the Collier patent, burning occurs before the gas is thoroughly mixed with the combustion air and, by virtue thereof, incomplete combustion results and causes a sooty flame to be produced.

The present invention contemplates the provision of a new and improved burner head 30 which is constructed so as to permit cleaner burning of high heat value fuels such as butane. This is achieved by introducing a quantity of spinning combustion air into the burner head at a location upstream of the point where the fuel is introduced so that the combustion air premixes with the fuel prior to combustion thereof. As a result, the intensity of the mixture is reduced and rapid combustion is delayed until the fuel becomes thoroughly mixed with additional combustion air so as to promote clean burning.

More specifically, the burner head 30 includes a sleeve-like member 40 having a generally cylindrical upstream section 41 and a generally frustoconical downstream section 42. The upstream end portion of the cylindrical section 41 is internally threaded as indicated at 43 in FIG. 2 and is adapted to be threaded onto the downstream end portion of the gas pipe 27.

Located within the cylindrical section 41 of the sleeve 40 downstream of the threads 42 is a tubular element 45 which defines a nozzle for discharging gas from the pipe 27. The outer diameter of the gas nozzle 45 is cylindrical as is the inner diameter of the upstream end portion 46 of the nozzle. The inner diameter of the downstream portion of the nozzle is formed with a forwardly converging taper 47 which leads to an axially extending passage 48, the latter terminating in a discharge orifice 49 which is perpendicular to and opens axially out of the axially facing downstream end of the nozzle. In this instance, the nozzle 45 is rigidly secured in a fixed position within the cylindrical section 41 of the sleeve 40 by spot welding or the like.

The frustoconical section 42 of the sleeve 40 is formed with concentric outer and inner walls 50 and 51 which flare radially outwardly from the cylindrical section 41 upon progressing in a downstream direction. As shown most clearly in FIG. 2, the outer diameter of the outer wall 50 at the upstream end of the frustoconical section 42 is the same as the outer diameter of the cylindrical section 41 while the outer diameter of the outer wall at the downstream end of the frustoconical section is approximately equal to the inner diameter of the recuperator tube 35. Thus, the downstream end of the outer wall either engages the inner side of the recuperator tube or is spaced just slightly inwardly from the tube.

Figure 6:
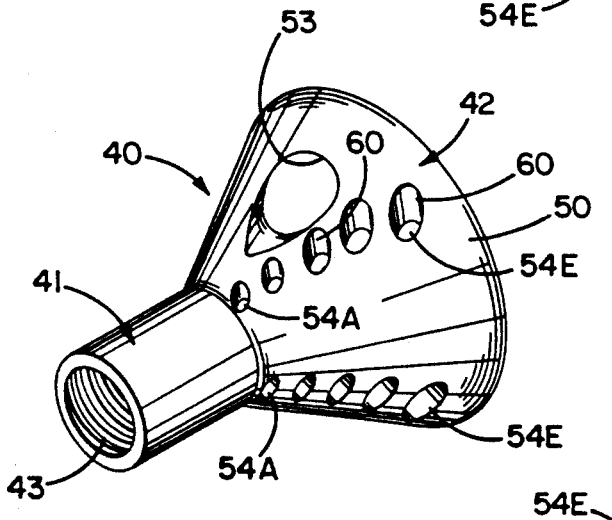
FIGS. 6 and 7 are perspective views of one component of the burner head.

A generally axially extending hole 53 (FIGS. 2, 4 and 6) is formed through the frustoconical section 42 of the sleeve 40 to accommodate the spark rod 32. A similar but somewhat smaller axially extending hole (not shown) may be spaced angularly from the hole 53 to accommodate a conventional peep tube (not shown) which enables observation of the flame.

In carrying out the invention, combustion air ports 54A–54E are formed through the frustoconical section 42 of the sleeve 40 and deliver combustion air into the sleeve for mixture with the gas discharged from the orifice 49, the ports being uniquely shaped and located so as to cause the air to spin and mix thoroughly with the gas. Herein, there are four angularly spaced rows of generally axially spaced ports 54A–54E, each row preferably having five ports. As shown most clearly in FIGS. 3 and 4, the extreme upstream port 54A of each row is significantly smaller in diameter than the extreme downstream port 54E. The intervening port 54D immediately adjacent the port 54E is the same diameter as the port 54E while the remaining two intervening ports 54B and 54C have a diameter falling approximately midway between the diameters of the ports 54A and 54E.

Figure 3:
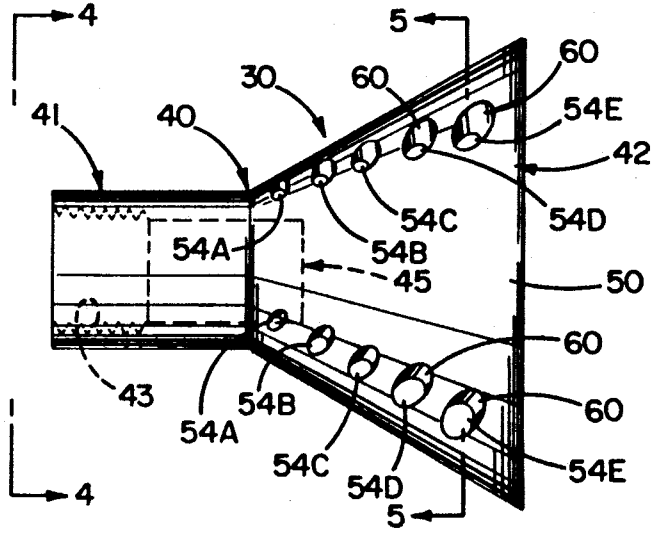
FIG. 3 is a side elevational view of the burner head.
Figure 4:
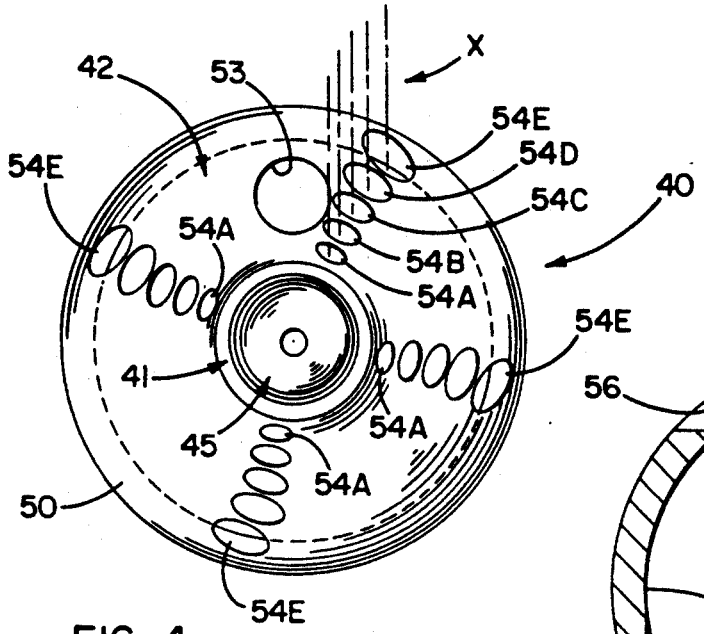
FIG. 4 is an end view as seen along the line 4—4 of FIG. 3.
Figure 5:
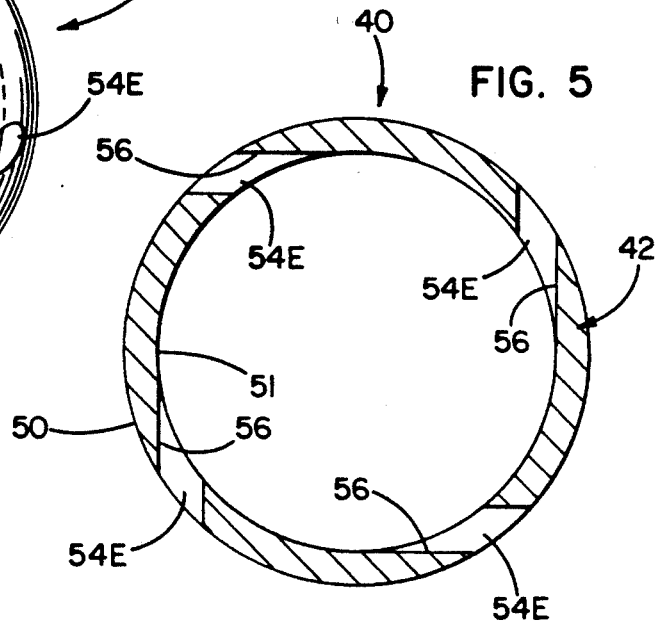
FIG. 5 is a cross-section taken substantially along the line 5—5 of FIG. 3.
Figure 7:
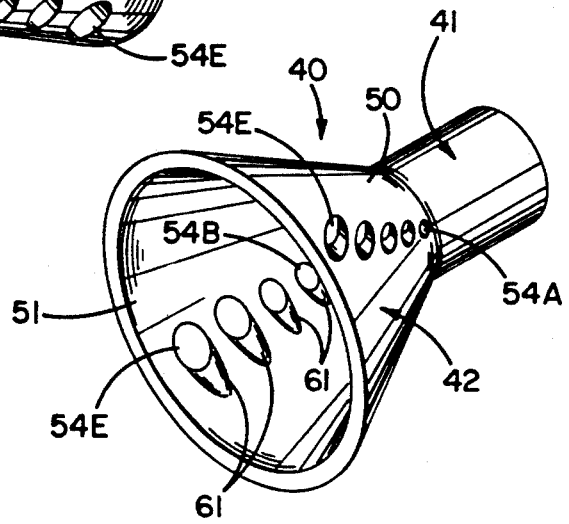

The ports 54A–54E of each row are formed by twist drills (not shown) whose axes lie along an array of lines indicated generally as X in FIG. 4. The drills are located such that one side 56 (FIG. 5) of each port extends along a line which is tangent to the circle defined by the inner wall 51 of the frustoconical section 42. By virtue of the drills penetrating the frustoconical section, each port is beveled at the outer side 50 of the frustoconical section 42 as indicated at 60 in FIGS. 3 and 6 and is formed with a teardrop-shaped runout or groove 61 (FIGS. 2 and 7) at the inner side 51 as shown in FIG. 7. Due to this configuration, a rotational spinning action is imparted to the combustion air as the air flows through the ports, the spinning being effected without need of providing vanes on the outer side 50 of the frustoconical section 42. Spinning of the combustion air promotes thorough mixing of the air with the gaseous fuel.

Figure 2:
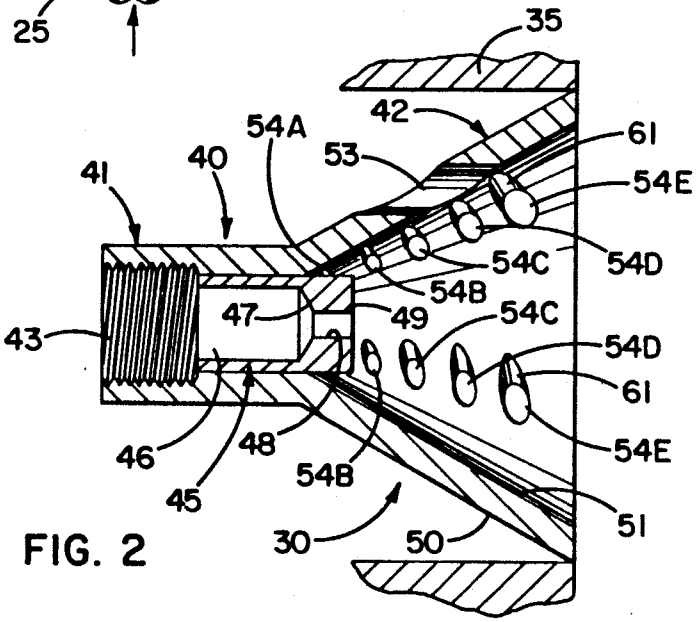
FIG. 2 is an enlarged cross-sectional view primarily illustrating the burner head shown in FIG. 1.

When butane is used as fuel, the gas nozzle 45 is located such that its discharge orifice 49 projects into the frustoconical section 42 and is axially located between the ports 54A and 54E of each row. Preferably, the discharge orifice 49 is located axially between the extreme upstream ports 54A and the most nearly adjacent intervening ports 54B as shown in FIGS. 2 and 3. By virtue of this arrangement, combustion air entering the upstream ports 54A and the adjacent ports 54B mixes with the butane immediately upon discharge of the butane from the orifice 49 and reduces the heating value of the mixture so as to slow down combustion thereof. The butane thus becomes thoroughly mixed with the combustion air entering the ports 54C–54E so as to produce a cleaner flame.

When the burner head 30 is used with a lower heat value gas such as propane, the gas nozzle 45 may be located such that the discharge orifice 49 is positioned slightly further upstream than is shown in FIGS. 2 and 3. If natural gas with a still lower heat value is used, the discharge orifice 49 is located even further upstream and preferably is positioned in approximately the same radial plane as the centers of the extreme upstream ports 54A. These locations of the discharge orifice reduce the quantity of combustion air that is mixed with the gas as the gas is first discharged from the nozzle and promote efficient burning of gases of lower heat values than butane.

I claim:

1. A recuperative radiant tube heating system, said system comprising an outer radiant tube made of heat resistant material and having a closed forward end, a recuperator tube located within said radiant tube and having an open forward end spaced upstream from the forward end of said radiant tube, a burner head located within said recuperator tube upstream of the forward end thereof, a gas supply pipe located within said recuperator tube for supplying gaseous fuel to said burner head, means upstream of said burner head for introducing combustion air into said recuperator tube for flow to said burner head, said recuperator tube being spaced radially inwardly from said radiant tube and coacting therewith to define an annular passage for the reverse flow of exhaust gases for preheating said combustion air prior to delivery of the combustion air to said burner head, said heating system being characterized in that said burner head comprises a sleeve having a generally cylindrical upstream section and a generally frustoconical downstream section, said cylindrical section being connected to said gas supply pipe, a gas nozzle communicating with said gas supply pipe, said nozzle having an upstream portion located within and fixed rigidly to said cylindrical section of said sleeve and having a downstream portion projecting into said frustoconical section of said sleeve, the downstream portion of said nozzle having a restricted orifice for discharging gas into the frustoconical section of said sleeve, the frustoconical section of said sleeve having substantially smooth and substantially frustoconical inner and outer sides each having a relatively small diameter upstream end and a larger diameter downstream end, said downstream end of said outer side being in close proximity to the inner side of said recuperator tube, angularly spaced rows of combustion air ports formed through said frustoconical section between the inner and outer sides thereof, the combustion air ports of each row being spaced from one another generally axially along said frustoconical section, said combustion air ports communicating with said recuperator tube to receive combustion air therefrom and being shaped and located so as to effect spinning of the combustion air as the combustion air passes through said ports to the inner side of said frustoconical section for mixture with the gas discharged from said orifice, each of said rows of combustion air ports including an extreme upstream port and an extreme downstream port, said orifice being located axially between the extreme upstream port of each row and the extreme downstream port of each row.

2. A system as defined in claim 1 in which each of said rows of combustion air ports includes at least one intervening port located between said orifice and the extreme downstream port of such row.

3. A system as defined in claim 2 in which each of said rows of combustion air ports includes a plurality of intervening ports located between said extreme upstream port and said extreme downstream port, said orifice being located axially between the extreme upstream port of each row and the most nearly adjacent intervening port of such row.

4. A system as defined in claim 3 in which each of said rows of combustion air ports consists of three of said intervening ports.

5. A system as defined in claim 2 in which the diameter of said intervening port of each row is larger than the diameter of said extreme upstream port of such row and is smaller than the diameter of said extreme downstream port of such row.

6. A system as defined in claim 1 in which the outer side of said frustoconical section of said sleeve is free of vanes.

7. A system as defined in claim I in which each of said ports is formed with a bevel adjacent the outer side of said frustoconical section and includes a groove on the inner side of said frustoconical section.

8. A system as defined in claim 7 in which each of said ports includes one side extending substantially tangent to the inner side of said frustoconical section.

* * * * *